US008845014B2

(12) United States Patent
Wong

(10) Patent No.: US 8,845,014 B2
(45) Date of Patent: Sep. 30, 2014

(54) MECHANICAL STRETCHING DEVICE FOR MULTIFUNCTIONAL CONVERTIBLE SOFA

(75) Inventor: Manli Wong, Guangdong (CN)

(73) Assignee: Man Wah Furniture Manufacturing (Huizhou) Co., Ltd., Huizhou (CN)

( * ) Notice: Subject to any disclaimer, the term of this patent is extended or adjusted under 35 U.S.C. 154(b) by 532 days.

(21) Appl. No.: 13/129,191

(22) PCT Filed: Oct. 25, 2010

(86) PCT No.: PCT/CN2010/078056

§ 371 (c)(1),
(2), (4) Date: May 13, 2011

(87) PCT Pub. No.: WO2011/060681

PCT Pub. Date: May 26, 2011

(65) Prior Publication Data

US 2012/0056462 A1 Mar. 8, 2012

(30) Foreign Application Priority Data

Nov. 19, 2009 (CN) ..... 2009 2 0200532 U

(51) Int. Cl.

| | |
|---|---|
| ***A47C 1/031*** | (2006.01) |
| ***A47C 1/034*** | (2006.01) |
| ***A47C 1/0355*** | (2013.01) |
| ***A47C 17/04*** | (2006.01) |

(52) U.S. Cl.

CPC ..... *A47C 17/04* (2013.01); *A47C 1/0355* (2013.01)

USPC ..... 297/85 R; 297/85 C

(58) Field of Classification Search

CPC ..... A47C 1/0355; A47C 1/0345

USPC ..... 297/85 R, 85 L, 85 C

See application file for complete search history.

(56) References Cited

U.S. PATENT DOCUMENTS 4,249,772 A * 2/1981 Rogers, Jr. ..... 297/85 R
4,815,788 A * 3/1989 May ..... 297/68

(Continued)

FOREIGN PATENT DOCUMENTS

CN 2555723 6/2003
CN 2815128 9/2006

(Continued)

OTHER PUBLICATIONS

International Search Report for international application No. PCT/CN2010/075056, dated Feb. 10, 2011 (6 pages)

*Primary Examiner* — David R Dunn
*Assistant Examiner* — Tania Abraham
(74) *Attorney, Agent, or Firm* — Hamre, Schumann, Mueller & Larson, P.C.

(57) ABSTRACT

A mechanical stretching device includes first, second, third and fourth foot levers, a side plate, first, second, third, fourth, fifth and sixth connecting rods, a first support member, a second support member, a linkage member, a connecting member, a rotating shaft transmission member, a spring, and a bottom connecting rod. A first limiting surface and a second limiting surface are disposed on the second foot lever, a third limiting surface is disposed on the fourth foot lever, a fourth limiting surface and a fifth limiting surface are disposed on the side plate, a sixth limiting surface and a seventh limiting surface are disposed on the second connecting rod, an eighth limiting surface is disposed on the sixth connecting rod, a ninth limiting surface is disposed on the first support member, and a tenth limiting surface is disposed on the linkage member.

7 Claims, 3 Drawing Sheets

(56) References Cited

U.S. PATENT DOCUMENTS

| | | | | | |
|---|---|---|---|---|---|
| 5,013,084 | A | * | 5/1991 | May | 297/85 R |
| 5,588,710 | A | * | 12/1996 | Wiecek | 297/463.1 |
| 5,992,930 | A | * | 11/1999 | LaPointe et al. | 297/68 |

FOREIGN PATENT DOCUMENTS

| | | |
|---|---|---|
| CN | 201175153 | 1/2009 |
| CN | 201571760 | 9/2010 |
| FR | 2543418 | 10/1984 |

* cited by examiner

MECHANICAL STRETCHING DEVICE FOR MULTIFUNCTIONAL CONVERTIBLE SOFA

BACKGROUND OF THE INVENTION

1. Field of the Invention

The invention relates to a mechanical stretching device for a multifunctional convertible sofa, which is mainly applied to a convertible sofa, and is a furniture component.

2. Related Art

A current mechanical stretching device for a convertible sofa has three major defects: 1. the length increased by unfolding is not consistent with the length reduced by folding, so that an iron frame cannot be unfolded or a soft pad in the front of a seat subsides to affect appearance; 2. a back is loose by about 40 mm, backs of a two-seat or three-seat functional sofa are not aligned, and a stagger distance is very long especially after stretching which affects the grade or style of the sofa; and 3. after a load is placed, the product subsides by about 40 mm, and the sofa is a certain distance away from the ground.

SUMMARY OF THE INVENTION

The invention is directed to a mechanical stretching device for a multifunctional convertible sofa which has a reasonably designed structure and optimal functions, so as to eliminate the above-mentioned defects in the prior art.

The technical solution used in the invention to solve the above problem is as follows. A mechanical stretching device for a multifunctional convertible sofa includes a first foot lever, a second foot lever, a third foot lever, a fourth foot lever, a side plate, a first connecting rod, a second connecting rod, a third connecting rod, a fourth connecting rod, a fifth connecting rod, a sixth connecting rod, a first support member, a second support member, a linkage member, a connecting member, such as a seahorse member in the following embodiment, a rotating shaft transmission member, a spring, and a bottom connecting rod.

One end of the sixth connecting rod is rotatably connected to the fourth foot lever, the other end of the sixth connecting rod is rotatably connected to the rotating shaft transmission member; the fourth foot lever is rotatably connected to the side plate, the fifth connecting rod, and the second foot lever respectively; the third foot lever is rotatably connected to the side plate, the first foot lever, and the second foot lever respectively; the second support member is rotatably connected to the bottom connecting rod and the fourth connecting rod respectively; the fourth connecting rod is rotatably connected to the second connecting rod and the linkage member respectively; the second connecting rod is rotatably connected to the side plate; the third connecting rod is rotatably connected to the second support member and the seahorse member respectively; the seahorse member is rotatably connected to the side plate and the fifth connecting rod respectively; the linkage member is rotatably connected to the side plate, the first connecting rod, and the first support member respectively; the first support member is rotatably connected to the bottom connecting rod; and one end of the spring is fixed on the side plate, and the other end of the spring is fixed on the sixth connecting rod.

According to the invention, a first limiting surface and a second limiting surface are disposed on the second foot lever, a third limiting surface is disposed on the fourth foot lever, a fourth limiting surface and a fifth limiting surface are disposed on the side plate, a sixth limiting surface and a seventh limiting surface are disposed on the second connecting rod, an eighth limiting surface is disposed on the sixth connecting rod, a ninth limiting surface is disposed on the first support member, and a tenth limiting surface is disposed on the linkage member.

According to the invention, a leg portion limiting rivet fitting the second limiting surface and the first limiting surface is fixed on the third foot lever, a seat portion limiting rive fitting the fourth limiting surface and a lying posture limiting rivet fitting the seventh limiting surface are fixed on the side plate, a first sitting posture limiting rivet fitting the tenth limiting surface is fixed on the seahorse member, a second sitting posture limiting rivet fitting the ninth limiting surface and a third sitting posture limiting rivet fitting the fifth limiting surface are fixed on the linkage member, and a lock limiting rivet fitting the eighth limiting surface is fixed on the rotating shaft transmission member.

The invention further includes a calf plate and a foot rest plate, the calf plate is rotatably connected to the first foot lever and the second foot lever respectively, and the foot rest plate is rotatably connected to the second foot lever and the first foot lever respectively The invention further includes a handle, a pulling cable and a pulling cable rack; one end of the pulling cable is connected to the handle, the other end of the pulling cable is connected to the pulling cable rack; and the pulling cable rack is connected to the rotating shaft transmission member.

The invention further includes a back member, and the back member is rotatably connected to the first connecting rod and the side plate respectively.

The invention further includes a first mounting plate and a second mounting plate, and the first mounting plate and the second mounting plate are both fixed on the side plate.

Compared with the prior art, the invention has the following advantages and effects. 1. The structure is reasonably designed. 2. The length increased by unfolding is substantially the same as the length reduced by folding, a back is loose by about 3 mm, and a product subsides by about 2 mm, thereby keeping the grade and quality of the functional sofa as high as that of a fixed sofa in terms of appearance.

DETAILED DESCRIPTION OF THE INVENTION

Figure 1:
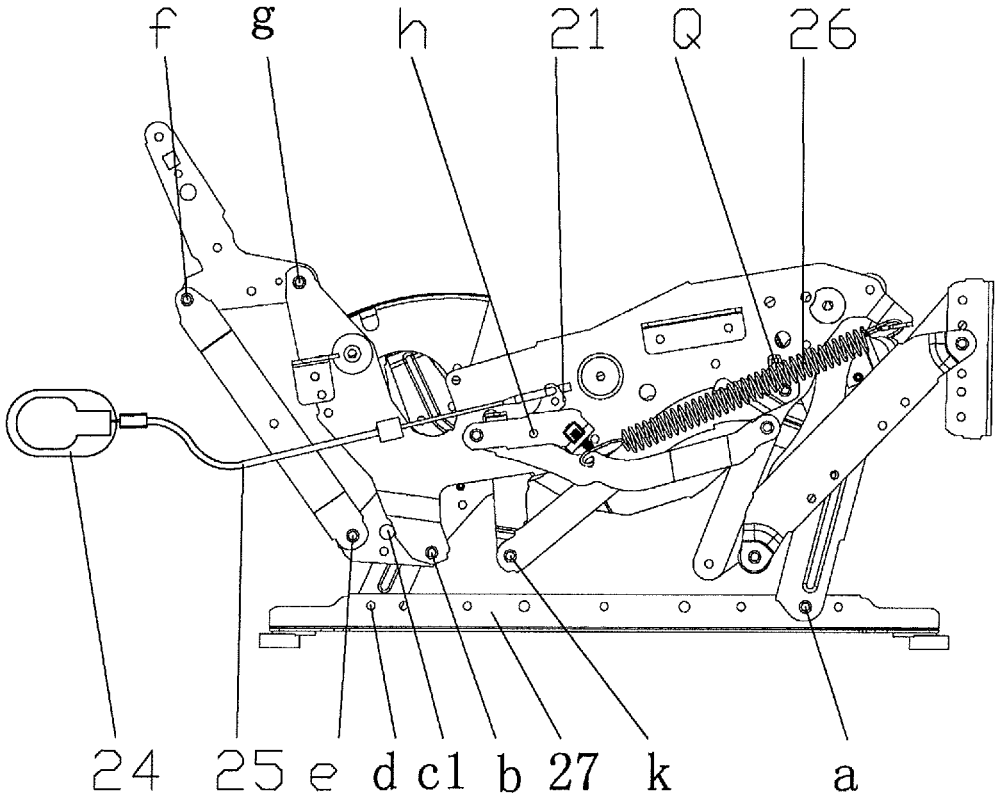
FIG. 1 is a schematic side structural view of a leg rest plate in a folded state according to an embodiment of the invention.
Figure 2:
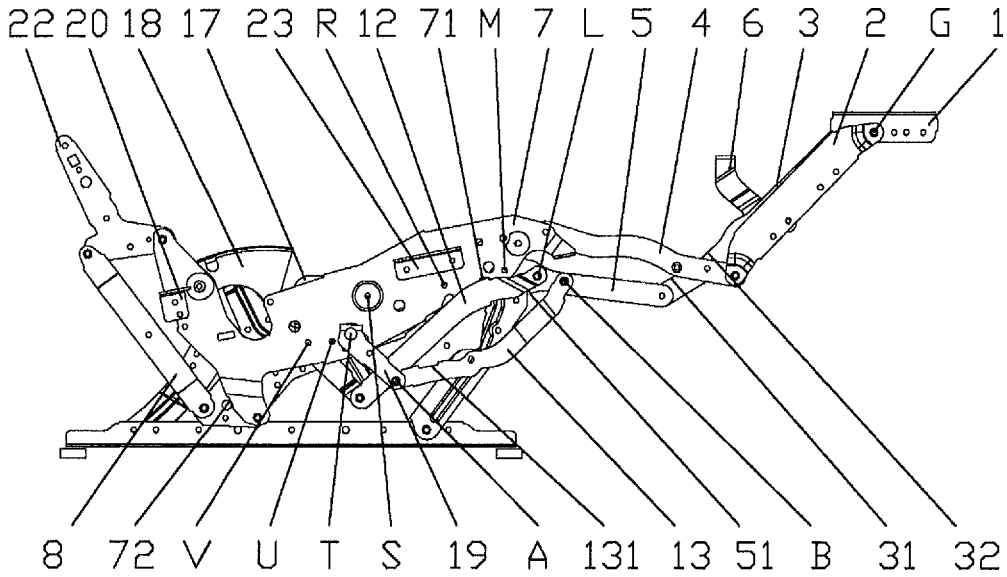
FIG. 2 is a schematic side structural view of a leg rest plate in a fully unfolded state according to an embodiment of the invention, which does not show a handle, a pulling cable, a pulling cable rack, and a spring.
Figure 3:
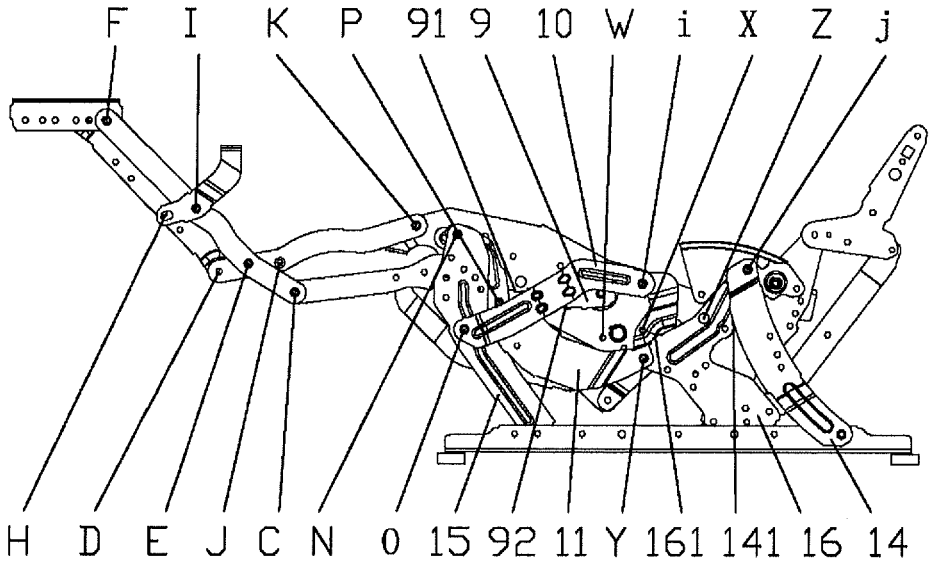
FIG. 3 is a reversed schematic structural view of FIG. 2.

The invention is further described below with reference to the accompanying drawings and embodiments.

Embodiment

Referring to FIG. 1 to FIG. 4, one end of a sixth connecting rod 13 is rotatably connected to a fourth foot lever 5 through a second rotating shaft B, and the other end of the sixth connecting rod 13 is rotatably connected to a rotating shaft transmission member 19 through a first rotating shaft A. The fourth foot lever 5 is rotatably connected to a side plate 7 through a twelfth rotating shaft M, rotatably connected to a fifth connecting rod 12 through an eleventh rotating shaft L, and rotatably connected to a second foot lever 3 through a third rotating shaft C respectively. One end of a third foot lever 4 is rotatably connected to a side plate 7 through a tenth rotating shaft K, the other end of the third foot lever 4 is rotatably connected to a first foot lever 2 through a fourth rotating shaft D, and meanwhile the third foot lever 4 is further rotatably connected to the second foot lever 3 through a fifth rotating shaft E. A calf plate 6 is rotatably connected to a first foot lever 2 through an eighth rotating shaft H, and rotatably connected to a second foot lever 3 through a ninth rotating shaft I respectively. A foot rest plate 1 is rotatably connected to the second foot lever 3 through a sixth rotating shaft F, and rotatably connected to the first foot lever 2 through a seventh rotating shaft G respectively. A second support member 15 is rotatably connected to a bottom connecting rod 27 through a twenty-first rotating shaft a, and is further rotatably connected to a fourth connecting rod 11 through a thirteenth rotating shaft N. The fourth connecting rod 11 is rotatably connected to a second connecting rod 9 through a fifteenth rotating shaft P, and rotatably connected to a linkage member 16 through a twentieth rotating shaft Y respectively. The second connecting rod 9 is rotatably connected to the side plate 7 through a sixteenth rotating shaft S. One end of a third connecting rod 10 is rotatably connected to the second support member 15 through a fourteenth rotating shaft O, and the other end of the third connecting rod 10 is rotatably connected to the seahorse member 17 through a twenty-seventh rotating shaft i. Meanwhile, the seahorse member 17 is rotatably connected to the side plate 7 through a nineteenth rotating shaft V, and rotatably connected to the fifth connecting rod 12 through a twenty-ninth rotating shaft k respectively. The linkage member 16 is rotatably connected to the side plate 7 through a twenty-second rotating shaft b, rotatably connected to a first connecting rod 8 through a twenty-fourth rotating shaft e, and rotatably connected to a first support member 14 through a twenty-eighth rotating shaft j respectively. The first support member 14 is rotatably connected to the bottom connecting rod 27 through a twenty-third rotating shaft d. A back member 22 is rotatably connected to the first connecting rod 8 through a twenty-fifth rotating shaft f, and rotatably connected to the side plate 7 through a twenty-sixth rotating shaft g respectively.

When legs are in a folded state, a lock limiting rivet h contacts with an eighth limiting surface 131, a leg portion limiting rivet J contacts with a second limiting surface 32, a third sitting posture limiting rivet c1 contacts with a fifth limiting surface 72, a seat portion limiting rivet Q contacts with a fourth limiting surface 71, a second sitting posture limiting rivet Z contacts with a ninth limiting surface 141, and a first sitting posture limiting rivet X contacts with a tenth limiting surface 161, thereby achieving a locking and limiting effect. When a driving force (normally an acting force produced by pulling a pulling cable rack 21 through a handle 24) is applied to a rotating shaft transmission member 19, the rotating shaft transmission member 19 rotates around a seventeenth rotating shaft T, so that the rotating shaft transmission member 19 transfers the force to the sixth connecting rod 13 through the first rotating shaft A to make the sixth connecting rod 13 move forwards. The connecting rod 13 makes the fourth foot lever 5 relatively rotate around the twelfth rotating shaft M through the second rotating shaft B. The fourth foot lever 5 drives the second foot lever 3 to move through the third rotating shaft C. The second foot lever 3 makes the third foot lever 4 relatively rotate around the tenth rotating shaft K through the fifth rotating shaft E. The third foot lever 4 drives the first foot lever 2 to move through the fourth rotating shaft D. The movement of the second foot lever 3 and the first foot lever 2 drives the foot rest plate 1 to rotate through the sixth rotating shaft F and the seventh rotating shaft G, and meanwhile drives the calf plate 6 to rotate through the ninth rotating shaft I and the eighth rotating shaft H. The calf plate 6 is an optional part, and does not affect stretching of whole legs. When a user unfolds legs thereof to rest his legs, the calf plate 6 provides a support, which makes the user more comfortable. Meanwhile, with a pulling force of a spring 26, the whole movable leg rest produces a stretching movement. When the leg portion limiting rivet J contacts with the first limiting surface 31, a limiting affect is achieved, and the movable leg rest reaches a fully stretched state. During a stretching process of the movable leg rest, the fourth foot lever 5 drives the fifth connecting rod 12 to move forwards through the eleventh rotating shaft L, the fifth connecting rod 12 makes the seahorse member 17 rotate around the nineteenth rotating shaft V through the twenty-ninth rotating shaft k, the seahorse member 17 rotates around the fourteenth rotating shaft O through the twenty-seventh rotating shaft i, the third connecting rod 10 drives the fourth connecting rod 11 to move forwards through the thirteenth rotating shaft, the fourth connecting rod 11 drives the linkage member 16 to move forwards through the twentieth rotating shaft, the linkage member 16 drives the first support member 14 to move forwards through the twenty-eighth rotating shaft j, and in the process, the twenty-sixth rotating shaft g, the twenty-fifth rotating shaft f, the twenty-fourth rotating shaft e, the twentieth rotating shaft Y, the fifteenth rotating shaft P, and the sixteenth rotating shaft S between the back member 22, the side plate 7, the first connecting rod 8, the linkage member 16, the fourth connecting rod 11, and the second connecting rod 9 do not rotate relatively, so that the back member 22, the side plate 7, the first connecting rod 8, the linkage member 16, the fourth connecting rod 11, and the second connecting rod 9 are as a whole during the stretching process of the movable leg rest.

Figure 4:
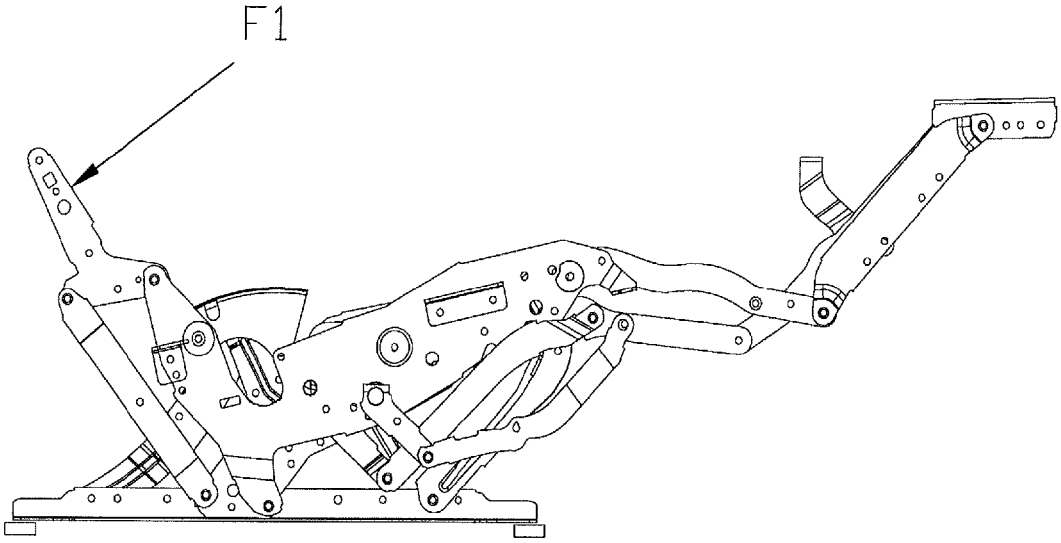
FIG. 4 is a schematic side structural view of a back member in a fully inclined state according to an embodiment of the invention, which does not show a handle, a pulling cable, a pulling cable rack, and a spring; and in the figures: 1. foot rest plate, 2. first foot lever, 3. second foot lever, 31. first limiting surface, 32. second limiting surface, 4. third foot lever, 5. fourth foot lever, 51. third limiting surface, 6. calf plate, 7. side plate, 71. fourth limiting surface, 72. fifth limiting surface, 8. first connecting rod, 9. second connecting rod, 91. sixth limiting surface, 92. seventh limiting surface, 10. third connecting rod, 11. fourth connecting rod, 12. fifth connecting rod, 13. sixth connecting rod, 131, an eighth limiting surface, 14. first support member, 141. ninth limiting surface, 15. second support member, 16. linkage member, 161. tenth limiting surface, 17. seahorse member, 18, protective member, 19. rotating shaft transmission member, 20. first mounting plate, 21. pulling cable rack, 22. back member, 21 second mounting plate, 24. handle, 25. pulling cable, 26. spring, 27. bottom connecting rod, A. first rotating shaft, B. second rotating shaft, C. third rotating shaft, D. fourth rotating shaft, E. fifth rotating shaft, F, sixth rotating shaft, G. seventh rotating shaft, H. an eighth rotating shaft, I, ninth rotating shaft, J. leg portion limiting rivet, K. tenth rotating shaft, L. an eleventh rotating shaft, M. twelfth rotating shaft, N. thirteenth rotating shaft, O. fourteenth rotating shaft, P. fifteenth rotating shaft, Q, seat portion limiting rivet shaft, R. seat portion limiting rivet, S. sixteenth rotating shaft, T. seventeenth rotating shaft, U. an eighteenth rotating shaft, V. nineteenth rotating shaft, W. lying posture limiting rivet, X. first sitting posture limiting rivet, Y. twentieth rotating shaft, Z. second sitting posture limiting rivet, a. twenty-first rotating shaft, b. twenty-second rotating shaft, c1. third sitting posture limiting rivet d. twenty-third rotating shaft, e. twenty-fourth rotating shaft, f. twenty-fifth rotating shaft, g. twenty-sixth rotating shaft, h. lock limiting rivet, i. twenty-seventh rotating shaft, j. twenty-eighth rotating shaft, and k. twenty-ninth rotating shaft.

When a force F1 in the direction shown in FIG. 4 is applied (normally by weight of the user) to the back member 22, the back member rotates around the twenty-sixth rotating shaft g, the back member 22 makes the first connecting rod 8 rotate through the twenty-fifth rotating shaft f, the first connecting rod 8 drives the linkage member 16 to rotate around the twenty-second rotating shaft b through the twenty-fourth rotating shaft e, meanwhile the linkage member 16 drives the first support member 14 by rotatable connection through the twenty-eighth rotating shaft j, the linkage member 16 drives the fourth connecting rod 11 by rotatable connection through the twentieth rotating shaft Y, the fourth connecting rod 11 drives by rotatable connection through the fifteenth rotating shaft P the second connecting rod 9 to rotate around the sixteenth rotating shaft S, and when the seventh limiting surface 92 contacts with a lying posture limiting rivet W, a limiting effect is achieved, and the back is in a fully inclined state.

It should be noted that, shapes and names of the parts and components in the specific embodiment described in the specification may be changed. Equivalent or simple modifications made according the ideas of the invention and the described construction, features, and principle all fall within the protection scope of the invention.

What is claimed is:

1. A mechanical stretching device for a multifunctional convertible sofa, comprising a first foot lever, a second foot lever, a third foot lever, a fourth foot lever, a side plate, a first connecting rod, a second connecting rod, a third connecting rod, a fourth connecting rod, a fifth connecting rod, a sixth connecting rod, a first support member, a second support member, a linkage member, a connecting member, a rotating shaft transmission member, a spring, and a bottom connecting rod; wherein one end of the sixth connecting rod is rotatably connected to the fourth foot lever, the other end of the sixth connecting rod is rotatably connected to the rotating shaft transmission member; the fourth foot lever is rotatably connected to the side plate, the fifth connecting rod, and the second foot lever respectively; the third foot lever is rotatably connected to the side plate, the first foot lever, and the second foot lever respectively; the second support member is rotatably connected to the bottom connecting rod and the fourth connecting rod respectively; the fourth connecting rod is rotatably connected to the second connecting rod and the linkage member respectively; the second connecting rod is rotatably connected to the side plate; the third connecting rod is rotatably connected to the second support member and the connecting member respectively; the connecting member is rotatably connected to the side plate and the fifth connecting rod respectively; the linkage member is rotatably connected to the side plate, the first connecting rod, and the first support member respectively; the first support member is rotatably connected to the bottom connecting rod; and one end of the spring is fixed on the side plate, and the other end of the spring is fixed on the sixth connecting rod.

2. The mechanical stretching device for a multifunctional convertible sofa according to claim 1, wherein a first limiting surface and a second limiting surface are disposed on the second foot lever, a third limiting surface is disposed on the fourth foot lever, a fourth limiting surface and a fifth limiting surface are disposed on the side plate, a sixth limiting surface and a seventh limiting surface are disposed on the second connecting rod, an eighth limiting surface is disposed on the sixth connecting rod, a ninth limiting surface is disposed on the first support member, and a tenth limiting surface is disposed on the linkage member.

3. The mechanical stretching device for a multifunctional convertible sofa according to claim 2, wherein a leg portion limiting rivet fitting the second limiting surface and the first limiting surface is fixed on the third foot lever, a seat portion limiting rive fitting the fourth limiting surface and a lying posture limiting rivet fitting the seventh limiting surface are fixed on the side plate, a first sitting posture limiting rivet fitting the tenth limiting surface is fixed on the connecting member, a second sitting posture limiting rivet fitting the ninth limiting surface and a third sitting posture limiting rivet fitting the fifth limiting surface are fixed on the linkage member, and a lock limiting rivet fitting the eighth limiting surface is fixed on the rotating shaft transmission member.

4. The mechanical stretching device for a multifunctional convertible sofa according to claim 1, further comprising a calf plate and a foot rest plate, wherein the calf plate is rotatably connected to the first foot lever and the second foot lever respectively, and the foot rest plate is rotatably connected to the second foot lever and the first foot lever respectively.

5. The mechanical stretching device for a multifunctional convertible sofa according to claim 1, further comprising a handle, a pulling cable, and a pulling cable rack, wherein one end of the pulling cable is connected to the handle, the other end of the pulling cable is connected to the pulling cable rack, and the pulling cable rack is connected to the rotating shaft transmission member.

6. The mechanical stretching device for a multifunctional convertible sofa according to claim 1, further comprising a back member, wherein the back member is rotatably connected to the first connecting rod and the side plate respectively.

7. The mechanical stretching device for a multifunctional convertible sofa according to claim 1, further comprising a first mounting plate and a second mounting plate, wherein the first mounting plate and the second mounting plate are both fixed on the side plate.

* * * * *